United States Patent [19]

Babitzka

[11] Patent Number: 4,660,522

[45] Date of Patent: Apr. 28, 1987

[54] FUEL INJECTION PUMP FOR INTERNAL COMBUSTION ENGINES

[75] Inventor: Rudolf Babitzka, Kirchberg, Fed. Rep. of Germany

[73] Assignee: Robert Bosch GmbH, Stuttgart, Fed. Rep. of Germany

[21] Appl. No.: 763,593

[22] Filed: Aug. 8, 1985

[30] Foreign Application Priority Data

Oct. 17, 1984 [DE] Fed. Rep. of Germany ..... 3437973

[51] Int. Cl.[4] ..... F02M 39/00

[52] U.S. Cl. ..... 123/450; 123/509; 123/458; 417/462

[58] Field of Search ..... 123/450, 458, 299, 300, 123/509, 495, 451; 417/462, 463, 460

[56] References Cited

U.S. PATENT DOCUMENTS

| | | | |
|---|---|---|---|
| 1,772,828 | 8/1930 | Egersdörfer | 417/462 |
| 3,604,406 | 9/1971 | Hattelet | 417/462 |
| 4,255,097 | 3/1981 | Davis | 417/462 |
| 4,486,154 | 12/1984 | Duplat | 417/462 |
| 4,499,883 | 2/1985 | Miyaki | 123/450 |
| 4,522,174 | 6/1985 | Babitzka | 123/300 |
| 4,575,316 | 3/1986 | Mowbray | 123/450 |

FOREIGN PATENT DOCUMENTS

| | | | |
|---|---|---|---|
| 359487 | 5/1938 | Italy | 123/450 |
| 286962 | 3/1928 | United Kingdom | 123/450 |
| 794116 | 4/1958 | United Kingdom | 123/450 |
| 2073331 | 10/1981 | United Kingdom | 123/450 |

*Primary Examiner*—Carl Stuart Miller
*Attorney, Agent, or Firm*—Edwin E. Greigg

[57] ABSTRACT

A fuel injection pump for internal combustion engines is proposed, which is realized as a radial piston pump. To supply eight-cylinder engines or multi-cylinder engines at high rpm or to realize a pre-injection with large angular intervals, a radial piston pump is proposed the pump pistons of which are firmly connected to the roller shoes driving the pump pistons, and the rollers carried by the roller shoes roll off simultaneously on a first cam track of a first, outer roller ring and on cam tracks of second, inner roller rings and are thereby compulsorily guided between the cam tracks of the two roller rings.

18 Claims, 5 Drawing Figures

FUEL INJECTION PUMP FOR INTERNAL COMBUSTION ENGINES

BACKGROUND OF THE INVENTION

The invention is based on a fuel injection pump for internal combustion engines as defined hereinafter. A fuel injection pump of this kind, known from German Auslegeschrift 10 39 309, is provided with a single pump piston, which is coupled with a rotationally driven cam disk provided on the top and bottom with a cam track and which is guided between rollers of a cam ring, adjustably supported in the circumferential direction only, on the top and rollers of a corresponding cam ring on the bottom. By the passage of the cam track between the rollers, which are stationary in the axial direction, the cam disk and pump piston are caused to reciprocate and rotate simultaneously. The pump piston here serves as a distributor as well. The pump work chamber enclosed by the pump piston communicates during the intake stroke of the pump piston with a fuel supply line, in which an adjustable intake throttle is disposed, by way of which the quantity of fuel that is to be injected per pumping stroke is metered.

In distributor fuel injection pumps of the radial piston type, it is known for the pump pistons, which are supported radially in a rotationally drive distributor in pump cylinders, to be driven by means of a cam ring which radially surrounds the distributor and has faces which point radially inward. During the intake stroke the pump pistons are moved outward toward the cam ring, under the influence of the fuel pressure and centrifugal force, and during the pumping stroke they are moved inward once again, via roller shoes, by means of the cam elevations until reaching a dead center point that is determined by the cam height. In such pumps the fuel quantity is regulated via limiting the outward movement of the pistons, either by means of an adjustable stop or by means of a hydraulic limitation, in which during the intake stroke either the fuel supply is throttled or its timing is controlled. In these pumps, there is the disadvantage that a predetermined stroke sequence per unit of time, which is a product of the rpm and the number of pumping strokes per revolution, cannot be exceeded, because then the pump piston can no longer follow the cam track during the intake stroke unless special auxiliary means are provided. There are also limits on the use of restoring springs in such pumps. The problems associated with the pump piston rising from the cam track and with the vibrations of restoring springs are well known.

OBJECT AND SUMMARY OF THE INVENTION

The fuel injection pump according to the invention has the advantage over the prior art that by the compulsory guidance of the pump pistons, pumping strokes even in excess of six, at the high operating speeds of modern internal combustion engines, can be provided without difficulty and without affecting the accuracy of fuel metering. A particularly advantageous structure is disclosed in which it is assured that the parts rolling off on one cam track are not subjected to wear by means of friction on the other cam track, which moves in the opposite direction from this rolling part.

By means of the further development revealed herein even multiple injections in each of the cylinders of the engine that are to be supplied can be performed with a fuel injection pump embodied in this way, and the fuel injection quantity and rate can also be defined by the cam shape in accordance with this disclosure.

With an embodiment according to this invention, both a pre-injection and main injection of fuel in each of the cylinders, for instance in a four-cylinder engine, are advantageously possible, and the engine can nevertheless be driven at high rpm even then. The preinjection advantageously takes place in the first part of the intake stroke of the piston in a four-stroke engine, and the main injection takes place in the point prior to top dead center of this piston which is correct from the standpoint of proper combustion. The result, as is known, is a considerable improvement in terms of toxic emissions, soot development and noise in an engine operating with self-ignition. As a result of this injection, a more uniform and thorough combustion of the entire charge of the combustion chambers takes place, because at least the fuel quantity introduced by the pre-injection can be substantially homogeneously prepared over the relatively long period of time elapsing between the onset of fuel intake and the end of compression, or the ignition onset. The Diesel engine is known to suffer from the fact that the injected fuel has only a little time available for its preparation, because at the same time as injection, the onset of ignition must be controlled as well. Accordingly, the rpm of Diesel engines cannot be increased arbitrarily, because then incomplete combustion takes place, causing power losses on the one hand and increased toxic emissions and soot emissions, in particular, on the other. By means of the pre-injection, substantial improvements in both factors are attained.

In the Otto engine, on the contrary, a prepared fuel-air mixture is already present at the instant of ignition. However, if the Otto engine which operates with externally-supplied ignition is operated with direct fuel injection, which is intended to reduce intake losses as compared with the mixture-aspirating Otto engine, then the same advantages can be attained with injection in accordance with the present invention, because in that case the situation is similar to that in the Diesel engine.

The invention will be better understood and further objects and advantages thereof will become more apparent from the ensuing detailed description of a preferred embodiment taken in accordance with the invention.

DESCRIPTION OF THE PREFERRED EMBODIMENTS

Figure 1:
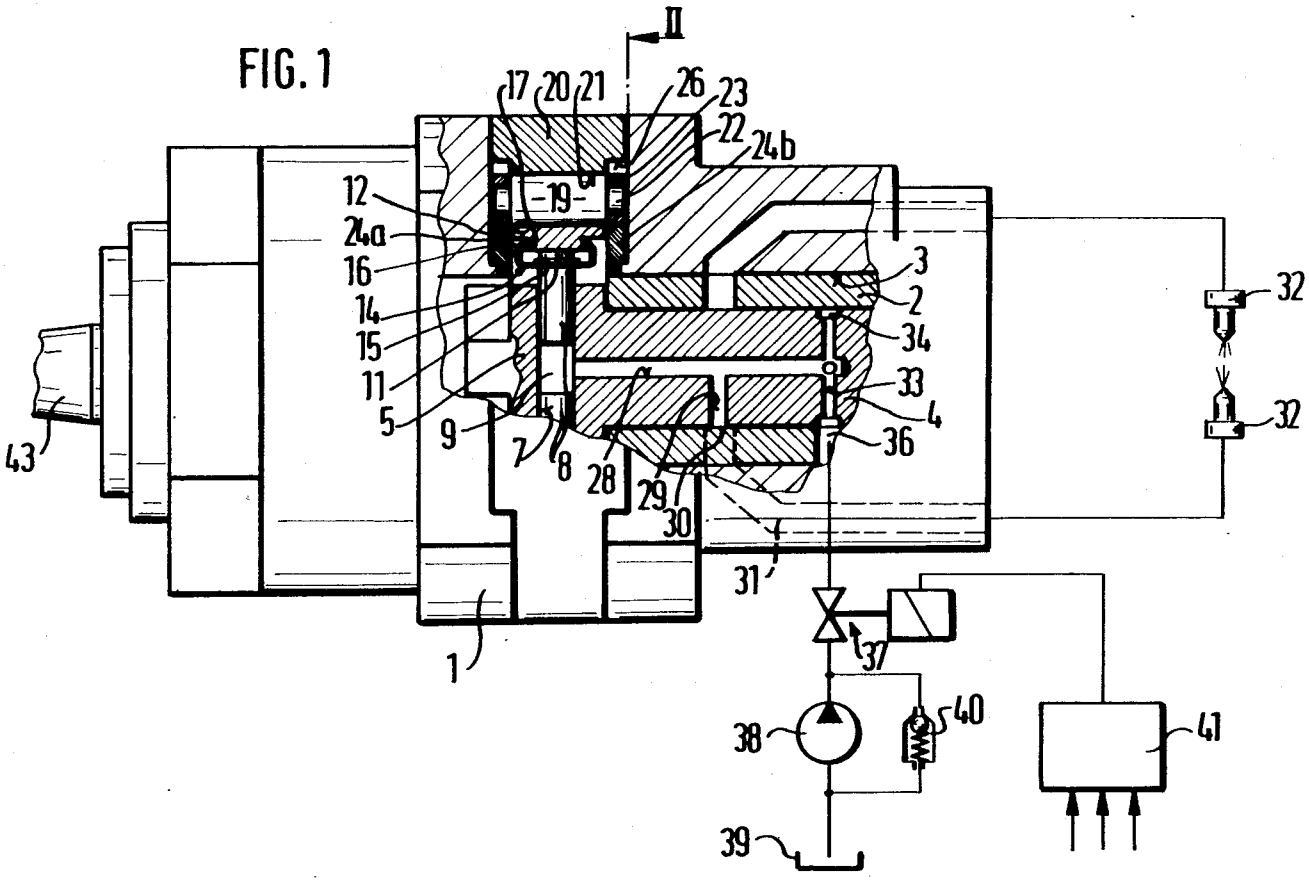
FIG. 1 shows a first exemplary embodiment of the invention with a partial cross section taken through a fuel injection pump shown in simplified form.

In FIG. 1, a radial piston distributor pump is shown in simplified form. Inserted into a housing 1 of this pump is a cylinder bushing 2 having an inner guide cylinder 3 in which a distributor 4 is guided. The distributor 4 is enlarged in diameter at an end 5 which protrudes from the guide cylinder 3 and there has radial pump cylinders 7, that lead away from the axis of the distributor, in which pump pistons 8 are guided. The ends of the pump pistons which extend toward the axis of the distributor, enclose a pump work chamber 9. Two pump pistons 8, by way of example, are provided, and they are guided in a pump cylinder which extends diametrically through the end 5 of the distributor 4.

On the end 11 of the pump pistons that protrudes out of the pump cylinder, the pistons rest on a roller shoe or tappet 12, with which they are joined via a resilient clamp 14. The clamp 14, which is formed from a spring leaf, has an opening in the middle through which the pump piston is inserted; the pump piston then comes to rest with a collar 15 against the clamp. The clamp also has two resilient arms 16, which extend radially beyond the sides of the pump piston and engage detent points 17 of the roller shoe and to thereby retain the end face of the pump piston in contact with the roller shoe.

A roller 19 is supported in the roller shoe and is joined to the roller shoe in a known manner by being radially encompassed by the shoe over more than 180°.

Figure 2:
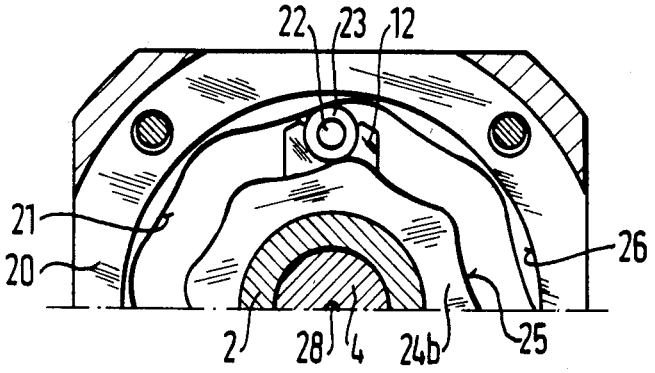
FIG. 2 is a partial cross section taken vertically to the sectional plane of the fuel injection pump of FIG. 1, showing the roller guidance.

In an axial extension of the pump piston axis, the rollers 19 are adjoined by a cam ring 20 which has cam faces pointing radially inward, which are visible in FIG. 2. The rollers have the same width as the cam track 21 of the cam ring and in an axial extension further include cylindrical lugs 22 on both ends, on which rings 23 are supported. These rings rest on the respective cam tracks 25 of second cam rings 24*a* and 24*b*. These cam rings are immediately adjacent laterally to the roller shoes 12. They are disk-shaped and have cam tracks 25 pointing radially outward, which extend in a radial arrangement parallel to the cam track 21 of the first cam ring 20.

The first cam ring permits a tolerance in the diameter of the rings 23, because laterally on both sides of the rings 23 and in their operative range, this first cam ring has notches 26 into which the rings 23 can protrude. For the same reason, the width of the rollers 19 is also selected such that they are capable of plunging together with the roller shoe 12 into the space between the two second cam rings 24*a* and 24*b*.

A pressure conduit 28 embodied as a blind bore extends inside the distributor, beginning at the pump work chamber 9. A radially extending transverse conduit 29 begins at this pressure conduit and discharges into a distributor opening 30 on the jacket face of the distributor. In the radial plane of this distributor opening, injection lines 31 lead away from the guide cylinder 3, being distributed about the circumference of the guide cylinder in accordance with the number and sequence of the cylinders of the associated engine that are to be supplied by the fuel injection pump. The injection lines 31 lead to injection nozzles 32, which are shown schematically.

The pressure conduit 28 further communicates via transverse bores 33 with a filling groove 34 which extends around the jacket face of the distributor. A continuous hydraulic communication is thereby attained with a fuel supply line 36 discharging into the guide cylinder 3 and in which a fuel metering valve 37 is disposed. The fuel supply line is supplied with fuel via a fuel supply pump 38 from a fuel supply container 39, and the fuel supply pressure can be adjusted in a known manner with the aid of a pressure control valve 40. The fuel metering valve 37 is shown merely symbolically here. It is controlled in accordance with operating parameters by a control unit 41 in such a manner that the desired fuel injection quantity per pump piston stroke attains injection. The fuel metering valve may be variously embodied, either as a fuel metering valve for metering fuel during the intake stroke or as a high-pressure valve for limiting the high-pressure supply during the supply stroke of the pump pistons. In the latter case, this valve is fully opened during the intake stroke. The triggering may be effected electrically, either directly or indirectly, for instance via a piezo-controlled hydraulic control slide in the manner disclosed in German Offenlegungsschrift 31 35 494.

The distributor 4 is set into rotary motion by a pump drive shaft 43. Because of the rotation of the distributor, the roller shoes 12 with the rollers 19 are carried along via the pump pistons 8 and the rollers then follow the cam tracks 21, 25 of the first roller ring 20 and the second roller rings 24*a* and 24*b*, respectively. Because of the embodiment of the rollers 19 with the aforementioned lugs 22 and the rings 23 as well as the two cam rings 20 and 24*a* and 24*b*, the rollers together with the roller shoe and the pump piston undergo compulsory guidance along the cam tracks. By coupling the pump pistons to the roller shoes, the pump pistons are thereby set into reciprocating motion when the distributor rotates. The pump pistons correspondingly execute intake strokes and pumping strokes, for instance receiving the fuel quantity that is to be pumped in the ensuing pumping stroke in a metered manner via the fuel metering valve 37 during either part or all of the intake stroke. At partial load, the connection between the fuel supply line and the pump work chamber is closed for a portion of the stroke, so that the pump work chamber does not fill completely with fuel and the pump piston attains the injection pressure correspondingly later in the ensuing pumping stroke. In this manner, an injection is realized with a constant end of supply and a load-dependent supply onset.

To set the supply onset, both cam rings can be rotated in a known manner, so that at either an earlier or a later angle position with respect to the rotational position of the pump drive shaft 43, the supply or injection begins. However, if the connection with the fuel supply line remains opened during the intake stroke of the pump pistons, then a control of the injection quantity can be achieved by providing that in the ensuing pumping stroke the fuel metering valve 37 is closed during the desired supply phase. In this manner, a desired injection onset or a desired end of injection can be controlled with this valve, without requiring any equipment for rotating the cam rings.

Figure 3:
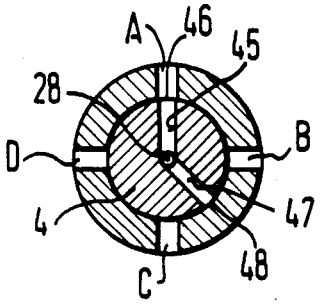
FIG. 3 is a cross section taken through the fuel injection pump of FIG. 1, showing the distributor openings, for a second form of embodiment of the invention.
Figure 4:
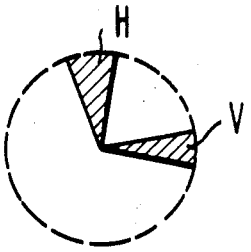
FIG. 4 is an injection diagram of the exemplary embodiment of FIG. 3.

In a second exemplary embodiment, corresponding to a further development of the first exemplary embodiment, instead of one transverse conduit 29, two transverse conduits are provided in the distributor, one of which, transverse conduit 45, leads to a first distributor opening 46, while the other transverse conduit 47 leads to a second distributor opening 48. The position of these conduits can be seen in FIG. 3 in the section taken through the distributor. As shown there, the second distributor opening 48 is in advance of the first distributor opening 46 by 135°, so that in a fuel injection pump for supplying four cylinders, having four injection lines 31 beginning at the guide cylinder 3, one of the distributor openings is always closed by the wall of the guide cylinder. In the position shown in FIG. 3, a fuel injection is effected through the first transverse conduit 45 and the first distributor opening 46 into a first fuel injection line A. After a further rotation of 45°, the second distributor opening 48 comes to coincide with an injection line C located diametrically opposite the injection line A, and so in this position injection take place through this injection line C. After yet another rotation of 45°, the first distributor opening 46 comes to coincide with an injection line B, and after a further 90° it coincides with the injection line B, whereupon a second fuel injection takes place into this injection line C, or in other words into the cylinder supplied by it. This second injection is 270° of crankshaft angle after the first injection that was effected through the second distributor opening 48. This relationship is illustrated by FIG. 4. The injection through the second distributor opening can be called the pre-injection V, and the injection through the first distributor opening 46 is called the main injection H. Since the injection pump is driven at half the rpm of the associated internal combustion engine, the distance between the pre-injection quantity V and the main injection H is 270° of crankshaft angle, if the distance between the first distributor opening 46 and the second distributor opening 48 is 135°. The pre-injection is effected in the beginning of the intake stroke, in a four-stroke engine, while the main injection takes place shortly before top dead center, at the end of the compression stroke. In a known manner in a Diesel engine, the onset of ignition is controlled by means of the main injection. The pre-injection quantity therefore has the range of 270° of crankshaft angle available to it for becoming mixed with the combustion air contained in the combustion chamber. The pre-injection quantity should be selected such that the self-ignition limit is not exceeded prior to the main injection.

Figure 5:
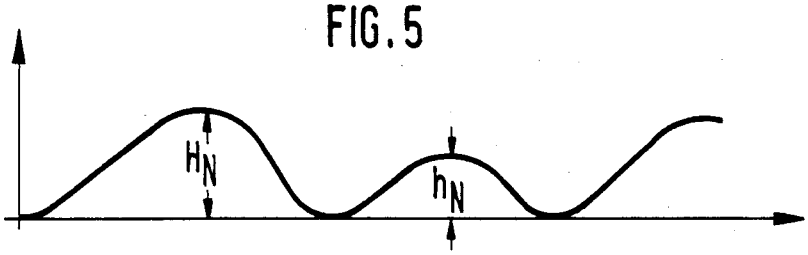
FIG. 5 shows the drive cam sequence in a realization of the second exemplary embodiment of FIG. 3.

This kind of fuel supply to an internal combustion engine with pre-injection and a main injection can be realized with the cam drive already shown in FIGS. 1 and 2. In a four-cylinder engine, eight pumping strokes per revolution are necessary, and they can be effected with a high degree of accuracy by means of the compulsory guidance of the pump piston. The fuel injection quantity can be controlled with the necessary accuracy by means of the metering valve 37, and it is possible for one of the partial injection quantitites to be kept constant and for this quantity to be determined by the cam shape or the cam stroke. This relationship is illustrated in FIG. 5, which shows a cam sequence with a large cam amplitude $H_N$ and a small cam amplitude $h_N$. Over the angular range $\alpha$ of the cam having the large cam amplitude $H_N$, the variation of the total injection quantity can be controlled. However, the small cams having the small cam amplitude $h_N$ and serving the purpose of the partial injections can also serve to effect a variable injection quantity over the cam elevation range $\beta$. The oscillating movement of the pump pistons is thereby reduced to a minimum, in that the small cam elements having the amplitude $h_N$ are adapted to the small fuel injection quantity correspondingly to be injected there. By appropriately embodying the cam tracks, on the other hand, it is also possible to set different angular intervals between the pre-injection quantity and the main injection quantity. All that need be done is to avoid angular ranges such as a 90° advance of the second distributor opening when supplying a four-cylinder in-line pump with fuel injection lines distributed at equal angular intervals on the circumference of the guide cylinder 3, because in that case injection would take place into two injection lines at once, which would not achieve the desired success.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A fuel injection pump for internal combustion engines comprising a housing, at least one reciprocable pump piston in a pump cylinder driven via a cam drive in said housing arranged to enclose a pump work chamber, said pump work chamber adapted to communicate via a pressure conduit with at least a distributor opening which connects said pump work chamber with a respective one of a plurality of fuel injection lines disposed in proximity to said distributor openings, said pump work chamber being arranged to receive fuel via a controlled fuel line connected to a fuel supply said fuel injection pump further including a radial piston injection pump provided with said pump piston, said pump piston further disposed in a radially aligned pump cylinder in a rotatingly driven distributor provided with at least one distributor opening and connected to a roller tappet, said roller tappet being arranged to be guided simultaneously between a first cam ring and a second cam ring, said cam rings being disposed in opposed relation, and said first cam ring has a cam track extending radially inward and said second cam ring has a cam track extending radially outward.

2. A fuel injection pump as defined by claim 1, further wherein said roller tappet is controlled by said first and second opposed cam rings, said cam rings having undulatory track surfaces to effect a complemental movement by said roller tappet therealong.

3. A fuel injection pump as defined by claim 1, further wherein said roller tappet engages a roller, which includes offstanding lugs each of said lugs arranged to engage cylindrical rings and further wherein each of said rings are adapted to roll off on a different one of said cam tracks, and wherein said roller tappet partially encompasses said roller in order to effect a positive connection therewith.

4. A fuel injection pump as defined by claim 3, further wherein said rollers as well as said rings and said roller tappet are guided laterally in said pump housing.

5. A fuel injection pump as defined by claim 4, further wherein said roller tappet is affixed to said pump piston by a resilient means.

6. A fuel injection pump as defined by claim 1, further wherein said fuel is controlled by means of a valve disposed in said fuel line and further wherein said valve is electrically controlled at least indirectly by a control unit.

7. A fuel injection pump as defined by claim 2, further wherein said fuel is controlled by means of a valve disposed in said fuel line and further wherein said valve is electrically controlled at least indirectly by a control unit.

8. A fuel injection pump as defined by claim 3, further wherein said fuel is controlled by means of a valve disposed in said fuel line and further wherein said valve is electrically controlled at least indirectly by a control unit.

9. A fuel injection pump as defined by claim 4, further wherein said fuel is controlled by means of a valve disposed in said fuel line and further wherein said valve is electrically controlled at least indirectly by a control unit.

10. A fuel injection pump as defined by claim 5, further wherein said fuel is controlled by means of a valve disposed in said fuel line and further wherein said valve is electrically controlled at least indirectly by a control unit.

11. A fuel injection pump as defined by claim 1, further wherein said at least one distributor opening comprises two distributor openings arranged to communicate with said pump work chamber, said two distributor openings being arranged in spaced relation from one another by a rotational angle.

12. A fuel injection pump as defined by claim 2, further wherein said at least one distributor opening comprises two distributor openings arranged to communicate with said pump work chamber, said two distributor openings being arranged in spaced relation from one another by a rotational angle.

13. A fuel injection pump as defined by claim 3, further wherein said at least one distributor opening comprises two distributor openings arranged to communicate with said pump work chamber, said two distributor openings being arranged in spaced relation from one another by a rotational angle.

14. A fuel injection pump as defined by claim 4, further wherein said at least one distributor opening comprises two distributor openings arranged to communicate with said pump work chamber, said two distributor openings being arranged in spaced relation from one another by a rotational angle.

15. A fuel injection pump as defined by claim 5, further wherein said at least one distributor opening comprises two distributor openings arranged to communicate with said pump work chamber, said two distributor openings being arranged in spaced relation from one another by a rotational angle.

16. A fuel injection pump as defined by claim 6, further wherein said at least one distributor opening comprises two distributor openings arranged to communicate with said pump work chamber, said two distributor openings being arranged in spaced relation from one another by a rotational angle.

17. A fuel injection pump as defined by claim 11, further wherein said distributor is disposed in a guide cylinder which communicates with said fuel injection lines and further that said fuel injection lines are spaced apart by 90° from said guide cylinder and the rotational angle interval between said two distributor openings is 135°.

18. A fuel injection pump as defined by claim 11, further wherein said cam tracks of said cylindrical rings each have two different cam shapes, which follow one another in alternating succession.

* * * * *